United States Patent [19]

Paar

[11] 4,397,166

[45] Aug. 9, 1983

[54] MAGNETIC LOCK HAVING A BOLT AND LOCKING PIECES

[75] Inventor: Adalbert Paar, Vienna, Austria

[73] Assignee: Evva-Werk Spezialerzeugung von Zylinder-und Sicherheitsschloessern GmbH & Co., Vienna, Austria

[21] Appl. No.: 104,897

[22] Filed: Dec. 18, 1979

[30] Foreign Application Priority Data

Dec. 28, 1978 [AT] Austria ..... 9332/78

[51] Int. Cl.[3] ..... E05B 47/00

[52] U.S. Cl. ..... 70/276; 70/413

[58] Field of Search ..... 70/276, 339, 353, 354, 70/366, 413

[56] References Cited

U.S. PATENT DOCUMENTS 3,552,159 1/1971 Craig ..... 70/353

3,855,827 12/1974 Hallman ..... 70/339

4,220,021 9/1980 Burger ..... 70/276

4,229,958 10/1980 Burger ..... 70/366

*Primary Examiner*—Robert L. Wolfe

*Attorney, Agent, or Firm*—Michael J. Striker

[57] ABSTRACT

A magnetic locking device for a door comprises a latch slidable from a locking position to an unlocking position and vice versa, a locking element provided with a number of webs and slidably mounted within the latch for moving the latch between the locking and unlocking position, and a number of magnetic rotors in the latch. Each magnetic rotor is formed with a recess in which the respective web of the locking element is engageable when the latch is moved from the locking position to the unlocking position. The magnetic locking device is further provided with a blocking element engageable with the locking element in the locking position and unlocking position.

21 Claims, 16 Drawing Figures

MAGNETIC LOCK HAVING A BOLT AND LOCKING PIECES

Figure 1:
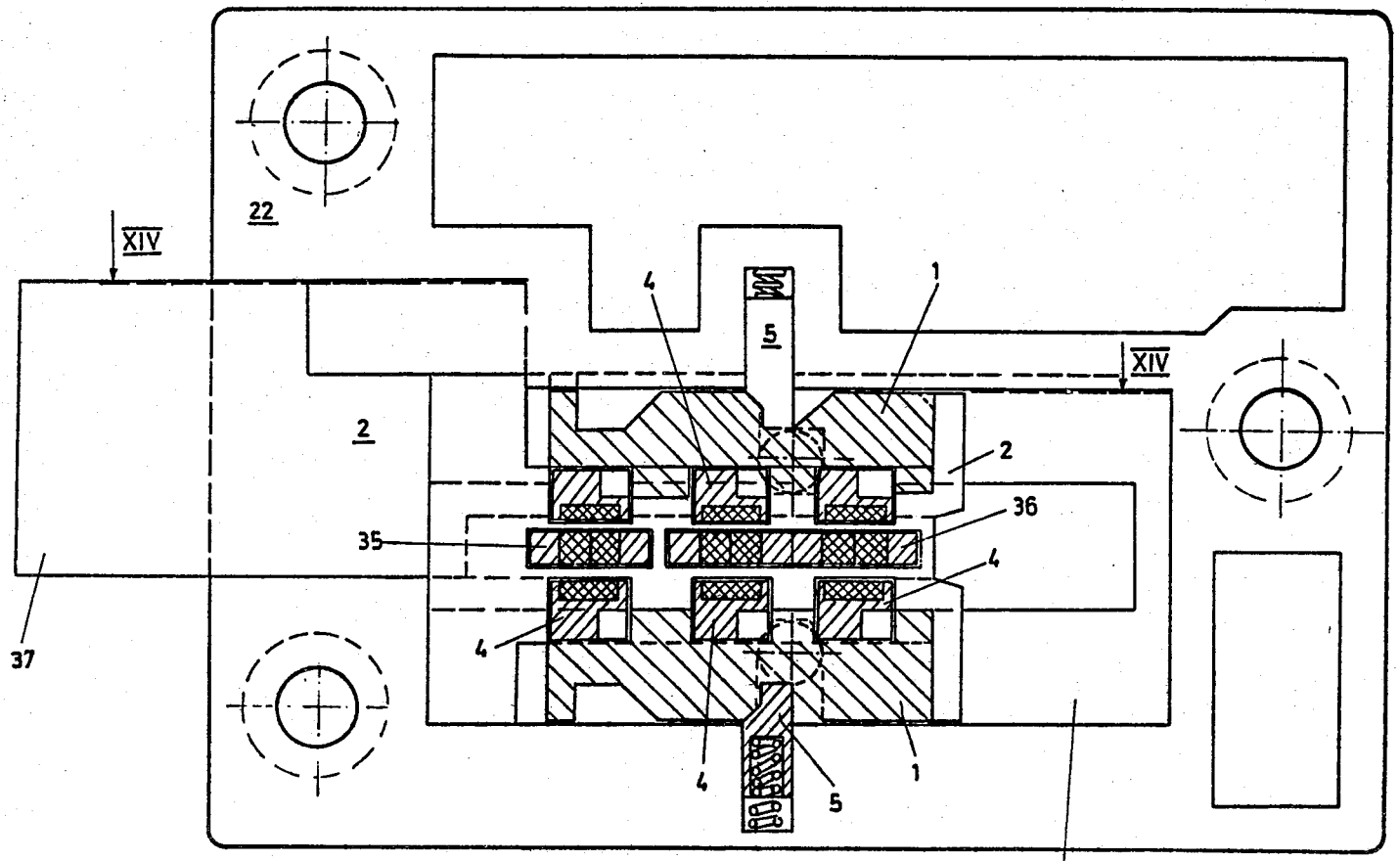

The invention relates to a magnetic lock with a latch and locking members which, upon the utilization of properly coded magnetic keys, are movable from a blocking position to a release position to permit shifting of the latch, and it is characterized in that locking plates are provided with ribs which upon a release movement of magnetic rotors are located opposite to recesses in these rotors, so that a relative displacement is made possible between the locking plates with their ribs and the magnetic rotors in the direction of shifting of the latch, and that blocking elements can be moved into and out of engagement of the locking plates for locking purposes.

The subject matter of the invention is illustrated by way of example in two embodiments in the drawing.

Figure 2:
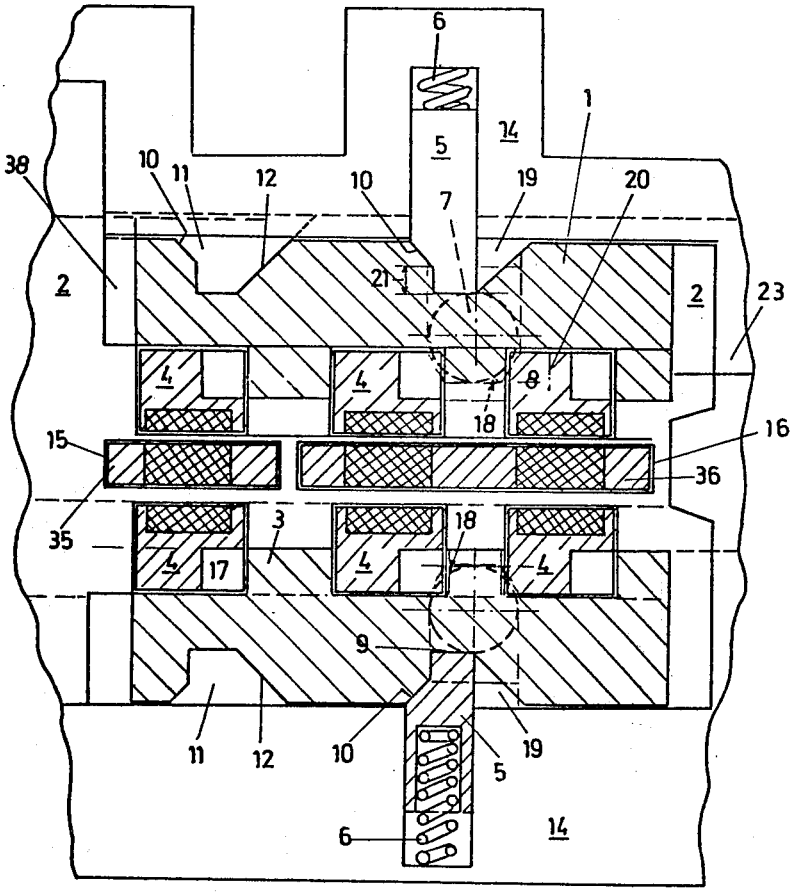
Figure 4:
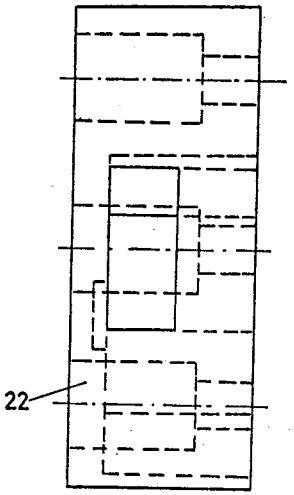
Figure 3:
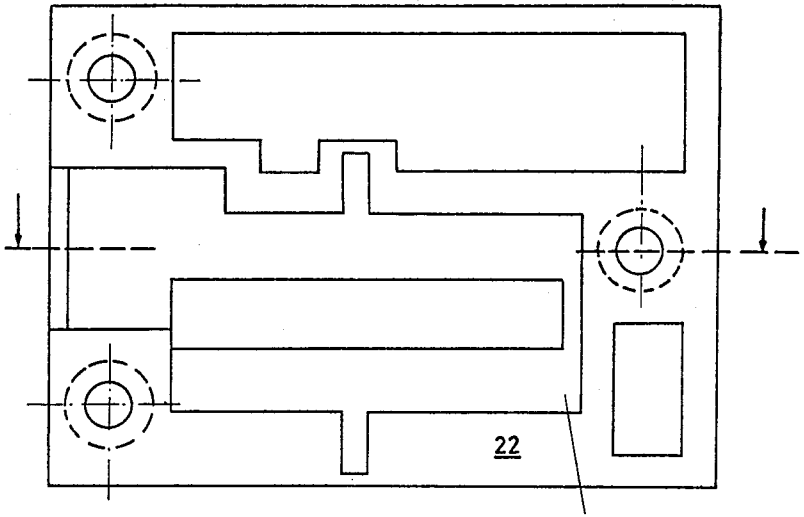
Figure 5:
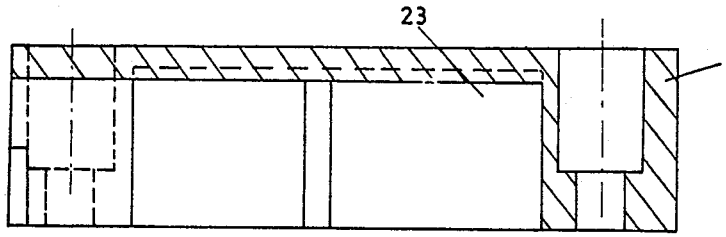
Figure 8:
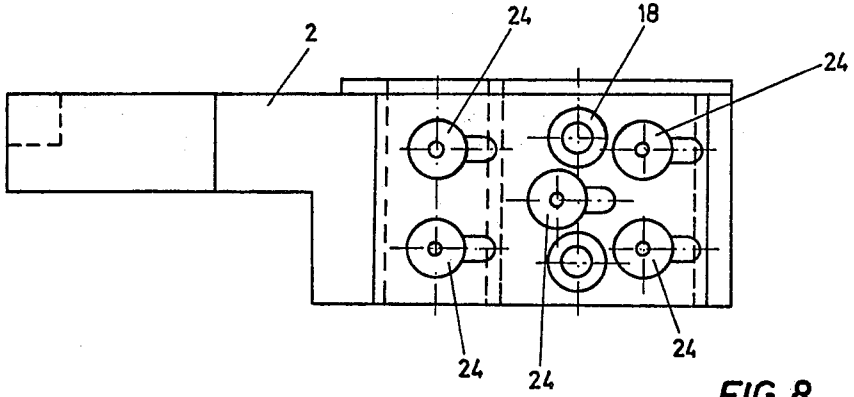
Figure 9:
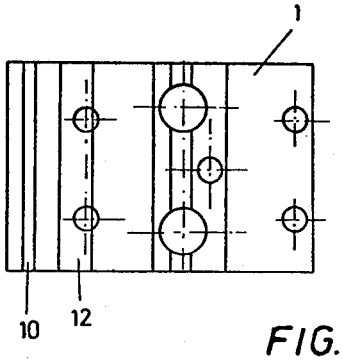
Figure 10:
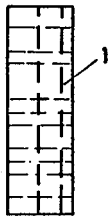
Figure 11:
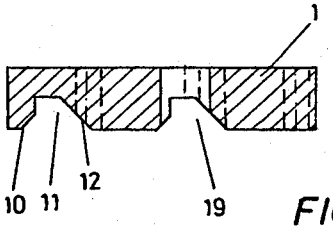
Figure 12:
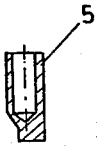
Figure 13:
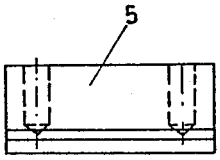
Figure 14:
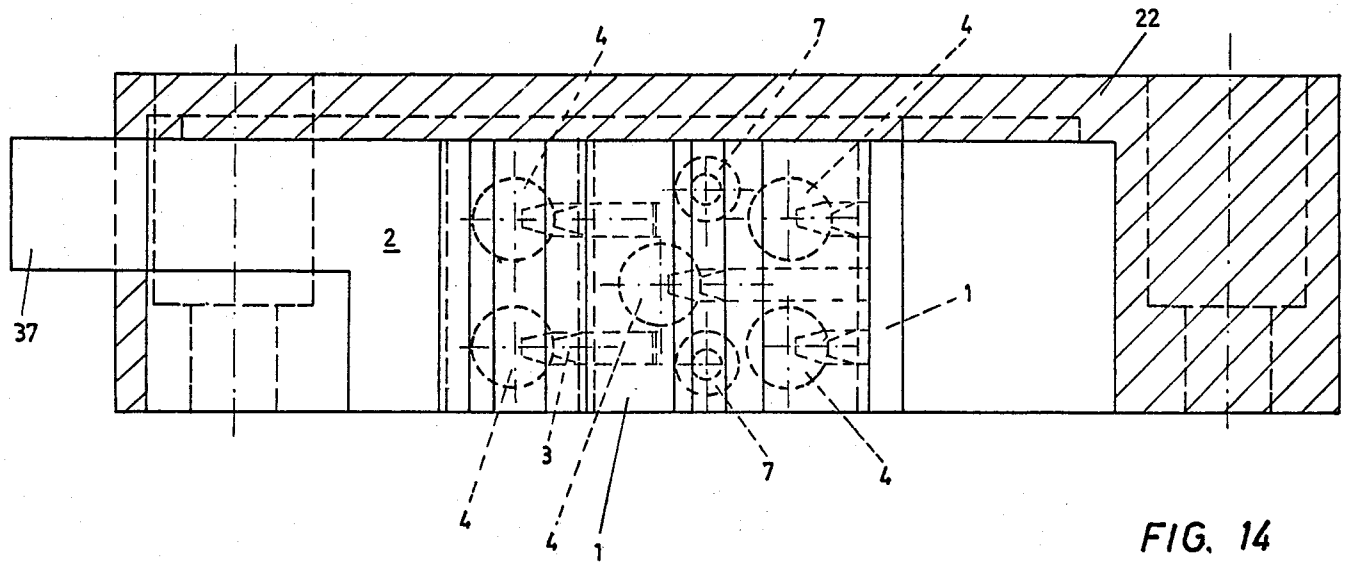
Figure 15:
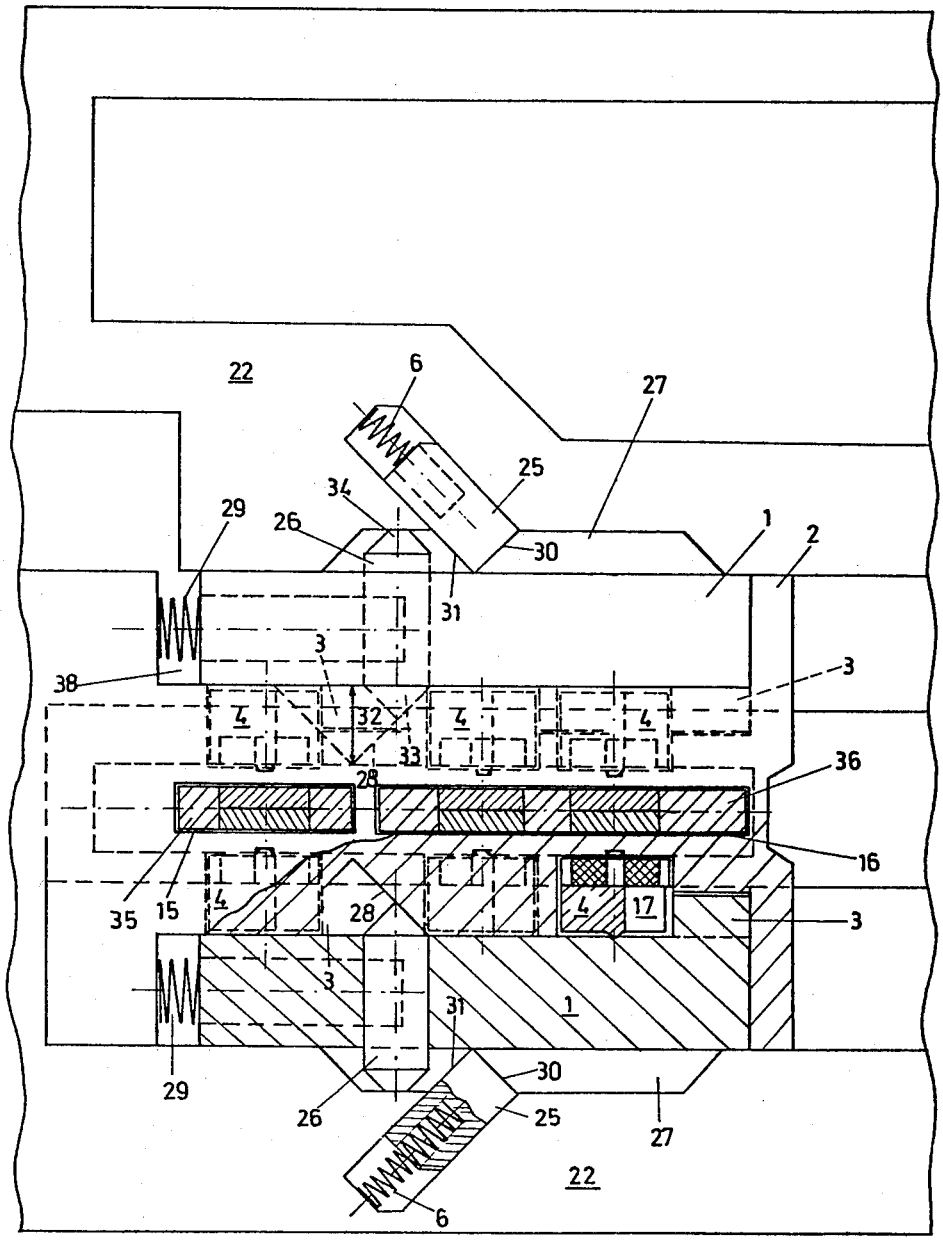
Figure 16:
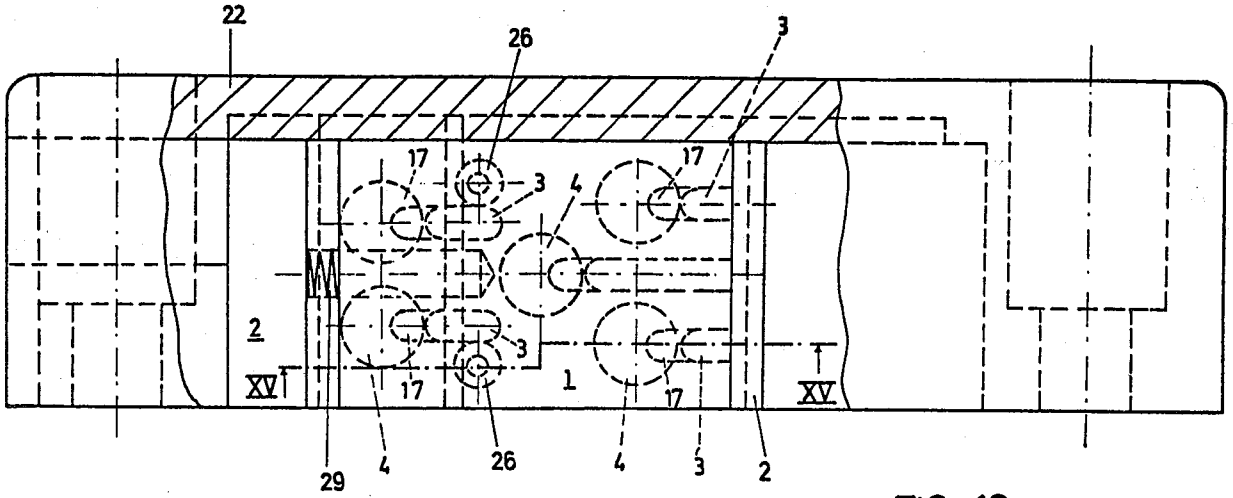

FIG. 1 illustrates, partly in section, an overview of the first embodiment. The center part of this lock with the actual locking mechanism is shown on an enlarged scale in FIG. 2. FIGS. 3–5 show in respective outline views the housing. The latch of the lock is also shown in respectively coordinated outline views, in FIGS. 6–8. FIGS. 9–11 show the locking plate also in associated outline views, and the blocking element is shown in FIGS. 12 and 13. FIG. 14, finally, is a section on line XIV—XIV of FIG. 1. FIGS. 15 and 16 show a second embodiment, with FIG. 15 corresponding to the FIG. 2 and FIG. 16 corresponding to the FIG. 14.

Figure 7:
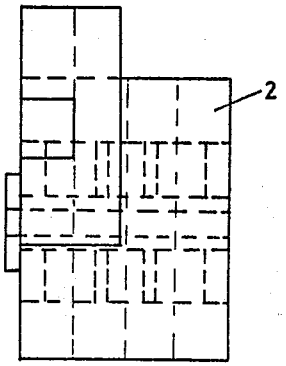
Figure 6:
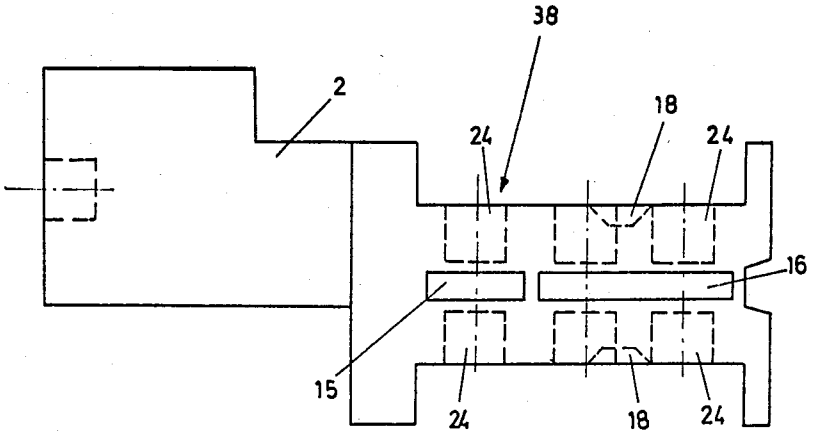

In principle, the magnetic lock of FIG. 1 has a housing 22 as illustrated in detail in FIGS. 3–5. These Figures are self-explanatory. In the recess 23 of the housing 22 a latch 2 is slidably arranged as illustrated in FIGS. 6–8. Key channels 15 and 16 are provided in the center plane of the latch and at opposite sides thereof magnetic rotors 4 are mounted. These magnetic rotors are journalled in cutouts 24 of the latch. The latch 2 ultimately serves with its left-hand illustrated section 37 for locking or unlocking purposes.

The additional parts of the construction can be explained most simply during the description of the operation of this slide lock. The slide lock has two locking plates 1 which are slidably mounted in the latch 2. The locking plates 2 have projections or inset pins 3 which at the appropriate position of the magnetic rotors 4 can enter into recesses 17 of these rotors.

If both keys (on the right side customer key 36, on the left side bank key 35) are the right keys with respect to their magnetic coding and are inserted into the key channels 15, 16, then the sliding of the latch 2 (see particularly FIG. 2) is effected in the following manner. The latch 2 is shifted to the right with the keys 35, 36, and in so doing the locking plates 1 initially remain fixed relative to the housing under the influence of locking elements 5 which are biased by spring 6 and mounted in the housing 22. The projections 3 enter into the recesses 17 of the magnetic rotors 4. During this shifting of the latch 2 the balls 7 which are journalled in depressions 18 of the latch, move along the conical surfaces 8 of the latch 2 in outward direction and thereby shift the locking member 5 partially outwardly counter to the springs 6.

Further shifting causes the inner edge 9 of the locking member 5 to ride onto the inclined part 10 of the recess 19 in the locking plate 1 and thus to move outwardly out of engagement with the locking plate 1. The latch 2 can now be shifted rightwards to open position over the entire functional path. Thereby it is obtained that the depth 20 of the recess 18 is the same or greater than the offset part 21 of the recess 19. At the end of this blocking path the locking members 5 enter into the recesses 11. The latch 2 is now in open position. Due to the entry of the locking members 5 into the recess 11 and the pressure of the springs 6 upon the inclination 12, the locking plate 1 is shifted within the latch 2 back towards the right into the starting position, but the latch is in its right-hand open position. The lock is open and now an e.g. door can be opened.

If in this position both keys are removed, then the rotors turn to an arbitrary position, such that a scanning of the magnetic coding of the rotors for the open position is not possible (protection against scanning).

To shift the latch 2 back and to close the lock the bank key is no longer needed; this can therefore remain in removed condition. For closing purposes the latch 2 is shifted with the customer key towards the left, so that the locking member 5 is pressed outwardly along the surface 12 and the shifting is enabled in the reverse manner, as described above. At the end of the shifting the lock is latched and the starting position for a renewed opening is established.

During the leftward shifting of the latch 2 no relative shifting of the locking plates 1 with respect to the latch 2 takes place, the latch 2 having been shifted back to its starting position as mentioned above.

In the present embodiment, as particularly evident from FIG. 4, 2×3 magnetic rotors 6 are provided for the customer key and 2×2 magnetic rotors 4 are provided for the bank key, resulting in appropriate variation possibilities on the order of more than 200,000 variations. Each locking member 5 acts upon two of the balls 7.

The second embodiment according to FIGS. 15 and 16 is essentially the same as the first embodiment. Here, also, a latch 2 is slidably arranged in a housing 22. Arranged in recesses at both sides of the key channels 15, 16 are locking plates 1 which are themselves shiftable and the projections 3 of which cooperate with the magnetic rotors 4 in the manner already described. Unlike the first embodiment, however, the locking plate 1 here is pre-tensioned from the left side by a spring 29 so that the locking plate in the rest position of the latch 2, i.e. in closed or open condition, is always in its right-hand end position.

The locking plate 1 carries transverse to its shifting direction a bolt 26 which is shiftable in the direction of its longitudinal axis. The bolt 26 is conical respectively frustoconical at both of its ends, whereby contact surfaces are formed. One of the ends 33 of the bolt 26 extends into a conical recess 28 of the locking member 2. The other end 34 of the bolt 26 extends at a certain position of the latch 2 into a recess 27 of the housing 22. Also extending into this recess 27, approximately under an angle of 45°, is a locking element 25 which is biased by spring 26.

Hereafter the operation of the invention according to the second embodiment will be described: In FIG. 5 the slide lock is shown in its left-hand closed condition. If with the appropriately magnetized magnetic keys 35 and 36 the latch 2 is shifted towards the right, then the end 34 of the bolt 26 abuts against the surface 31 of the locking element 25. If the latch 2 is shifted further towards the right, a relative displacement takes place between the locking plate 1 and the latch 2, causing the spring 29 to be compressed. At the same time a force acts upon the bolt 26 via the contact surface 31 in the direction of the conical recess 28 and the bolt is shifted out of the recess 27 into the conical recess 28. The depth 32 of the recess 28 is so selected that the end 34 of the bolt 26 fully enters into the locking plate 1 upon completed relative displacement of the plate 1 towards the left. During the relative displacement the projections 3 enter into the recesses of the magnetic rotors 4. The bolt 26 can now be moved past the locking element 25 and the latch be moved to the right-hand open position. The locking plate 1 returns thereby again to the right-hand end position.

If the unauthorized attempt is made to move the latch 2 without, or without properly coded, keys from the left closure position to the right open position, this is impossible. In this case the bolt 26 is restrained by the locking element 25 and cannot be pushed downwardly into the conical recess 28, because due to the turned magnetic rotors 4 the projections 3 abut against the circumferences of the magnetic rotors and the locking plate 1 cannot carry out any relative shifting movement.

If the latch is in its right-hand open position, then the latch can be moved left to the closed position even without inserted keys. The bolt 26 engages thereby the contact surface 30 of the locking element 25 and shifts this upwardly counter to the force of the springs 6. If the latch is in the left-hand closure position, then the locking element 25 returns to the position shown in FIG. 15 and the latch can now be shifted towards the right with the aid of the correct keys.

In the illustrated embodiments the locking mechanism of the slide lock is always illustrated symmetrically, i.e. the blocking construction elements are located at opposite sides of the key channels. In certain cases it may be adequate to arrange the blocking constructions only at one side of the key channels. Also, the number of bolts 26 and the number of magnetic rotors can be varied.

Due to the entry of the projections 3 into the recesses 17 of the magnetic rotors 4 in the direction of displacement of the latch the exertion of pressure upon the tip 13 of the mountings for the magnetic rotors 4 is avoided in an advantageous manner since in appropriate instances a pressure support of the circumferences of the rotors against the wall of recess 24 facing the latch takes place. The magnetic rotors 4 are also dust-tightly covered by the plates 1, since these plates are always pressed against the latch 2 by the springs 6. In direction transverse to the sliding direction only a single movement takes place, namely the movement of the locking element 5 and the balls 7 respectively the bolts 26.

Finally, the inventive slide lock is also simple and inexpensive to produce, since all parts may be made of e.g. Zamag.

The embodiments of the invention in which an exclusive property or privilege is claimed are defined as follows:

1. A magnetic lock system for a door or the like, comprising a casing having a cavity; a locking system in said cavity and comprising a latch slidable from a first locking position into a second unlocking position; at least one locking element slidably arranged within the latch for selectively moving the locking element between the first and the second position, the locking element being integrally provided with webs; a plurality of magnetic rotors arranged in the latch and each having a recess in which the respective web of the locking element is engageable when the latch moves from the first position into the second position, thereby obtaining a relative movement between the locking element and the magnetic rotors; and at least one blocking element supported within the casing and engaged with the locking element in the first position and in the second position.

2. A magnetic lock as defined in claim 1, wherein the locking element has a first recess in engagement with the blocking element in the first position, and a second recess in engagement with the blocking element in the second position.

3. A magnetic lock as defined in claim 2, wherein the blocking element is spring biased and constructed as a blocking bar.

4. A magnetic lock as defined in claim 3, wherein the blocking element has an end protruding into the first recess and provided with further blocking elements.

5. A magnetic lock as defined in claim 4, wherein the further blocking elements are constructed in form of balls which are supported in depressions arranged in the locking element.

6. A magnetic lock as defined in claim 2, wherein the first and the second recess of the locking element have inclined surfaces constructed as contact faces for cooperation with the blocking element and the balls.

7. A magnetic lock as defined in claim 5, wherein the depressions have inclined surfaces constructed as contact faces for cooperation with the blocking element and the balls.

8. A magnetic lock as defined in claim 6, wherein the first recess has a stepped part and the depression has a depth at least equal to the depth of the stepped part of the first recess.

9. A magnetic lock as defined in claim 1, wherein the lock has a median plane along which and in sliding direction of the latch, there are arranged several, key channels for different keys wherein several magnetic rotors are provided.

10. A magnetic lock as defined in claim 9, wherein two key channels are provided.

11. A magnetic lock as defined in claim 10, wherein four magnetic rotors are provided for one of said keys which is a bank key and six magnetic rotors are provided for another of said keys, which is a customer key.

12. A magnetic lock for a door or the like, comprising a casing having a cavity; a locking system in said cavity and comprising a latch slidable from a first locking position into a second locking position; at least one locking element slidably arranged within the latch for selectively moving the locking element between the first and the second position, the locking element being integrally provided with a plurality of webs; a plurality of magnetic rotors arranged in the latch and each having a recess engaging the respective web of the locking element when the latch moves from the first position into the second position, thereby obtaining a relative movement between the locking element and the magnetic rotors; at least one locking bolt supported by the locking element and transversely arranged to the sliding movement of the locking element; and at least one blocking element cooperating with the locking element.

13. A magnetic lock as defined in claim 12, wherein the locking bolt has one end constructed as conical shape and another end constructed as truncated conical shape, the locking bolt being movable in direction of its longitudinal direction.

14. A magnetic lock as defined in claim 13, wherein one end of the locking bolt cooperates with a conical recess within the latch into which recess the locking bolt is movable.

15. A magnetic lock as defined in claim 13, wherein the other end of the locking bolt protrudes in a recess arranged within the casing and transversely to the longitudinal direction along which recess the locking bolt is movable.

16. A magnetic lock as defined in claim 15, wherein the blocking element has one end projecting in the recess at a distance to the locking bolt, the projecting end being defined by two surfaces normal to each other and serving as contact surfaces.

17. A magnetic lock as defined in claim 16, wherein the blocking element is spring biased.

18. A magnetic lock as defined in claim 16, wherein the blocking element is arranged at an angle to the locking element which is smaller than 90°.

19. A magnetic lock as defined in claim 18, wherein the blocking element is arranged at an angle of 45° relative to the locking element.

20. A magnetic lock as defined in claim 12, wherein the locking element is biased by a spring in one direction the spring being arranged between the latch and the locking element.

21. A magnetic lock as defined in claim 12, wherein the conical recess has such a depth that upon moving of the latch from the first position into the second position, the one end of the locking bolt is insertable into the conical recess thereby obtaining relative movement of the latch and the locking element counter to the force of the spring while the other end of the locking bolt is movable out of engagement with the locking bar.

* * * * *

UNITED STATES PATENT AND TRADEMARK OFFICE

CERTIFICATE OF CORRECTION

PATENT NO. : 4 397 166

DATED : August 9,1983

INVENTOR(S) : Adalbert Paar

It is certified that error appears in the above—identified patent and that said Letters Patent is hereby corrected as shown below:

On the title page, the name of the assignee should read --EVVA WERK SPEZIALERZEUGUNG VON ZYLINDER-UND SICHERHEITSSCHLOESSERN GMBH & CO KOMMANDITGESELLSCHAFT--

Signed and Sealed this

*Twentieth* Day of *December 1983*

[SEAL]

*Attest:*

GERALD J. MOSSINGHOFF

*Attesting Officer*

*Commissioner of Patents and Trademarks*